United States Patent [19]

Thorn

[11] Patent Number: 5,058,965

[45] Date of Patent: Oct. 22, 1991

[54] COMBINATION DRAFTING TABLE AND OFFICE DESK

[76] Inventor: Everett Thorn, 3818 15th Ave., SE., Largo, Fla. 34640

[21] Appl. No.: 543,992

[22] Filed: Jun. 26, 1990

[51] Int. Cl.[5] ..... A47B 27/00

[52] U.S. Cl. ..... 312/231; 108/6; 312/194

[58] Field of Search ..... 108/6, 2; 312/231, 220, 312/194, 327

[56] References Cited

U.S. PATENT DOCUMENTS

| | | | |
|---|---|---|---|
| 468,929 | 2/1892 | Cochrane | 312/231 X |
| 508,142 | 11/1884 | Cutler | 312/220 |
| 1,956,546 | 4/1934 | Froelich | 108/2 |
| 2,067,309 | 1/1937 | Wogaman | 312/231 |
| 3,364,881 | 1/1961 | Kool | 108/2 X |
| 4,775,199 | 10/1988 | Lanius et al. | 312/220 |

*Primary Examiner*—Joseph Falk

*Attorney, Agent, or Firm*—Joseph C. Mason, Jr.; Ronald E. Smith

[57] ABSTRACT

A drafting table that is convertable into an office desk. A first pedal member allows the user to adjust the angle of a platform that supports a preselected drafting board and a second pedal member allows the user to adjust the position of the board with respect to the platform. The desk or table includes hingedly-mounted door members which lock automatically when the board-supporting platform is in its down position.

8 Claims, 6 Drawing Sheets

Fig. 4
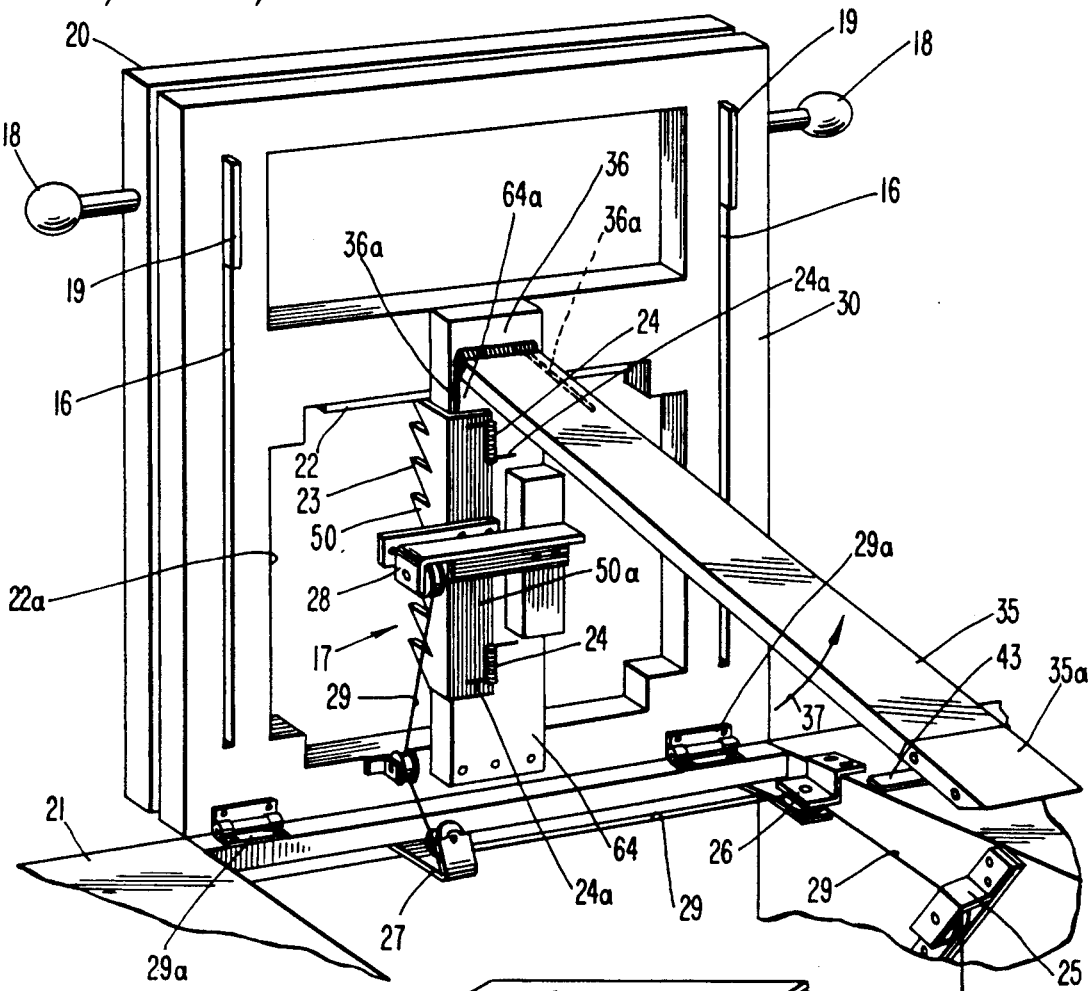
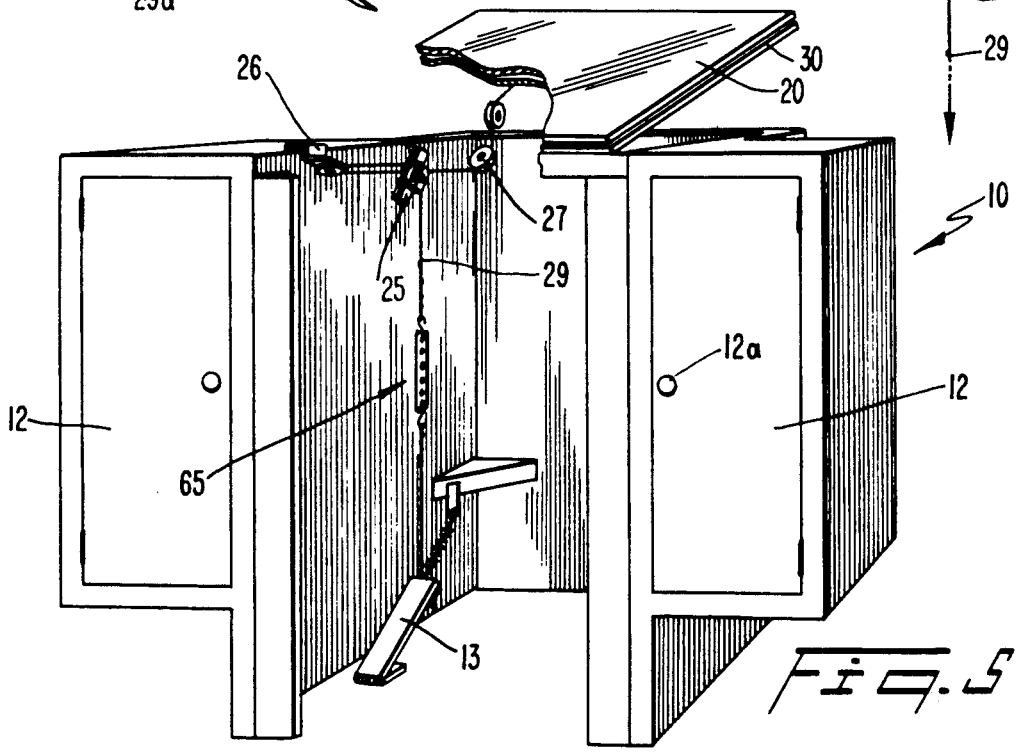
Fig. 5

Fig. 7C
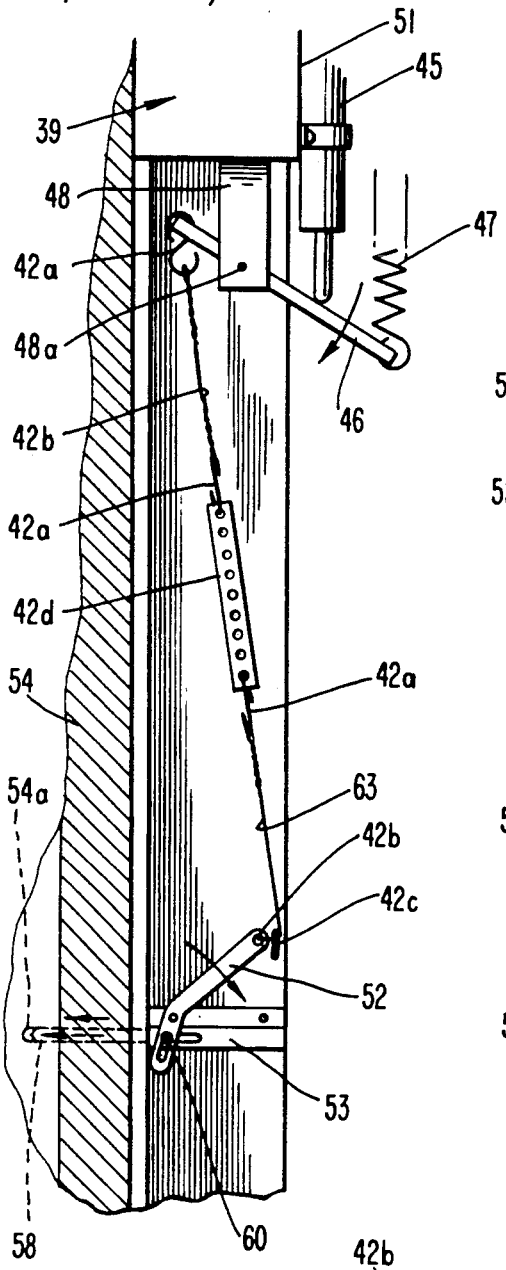
Fig. 7E
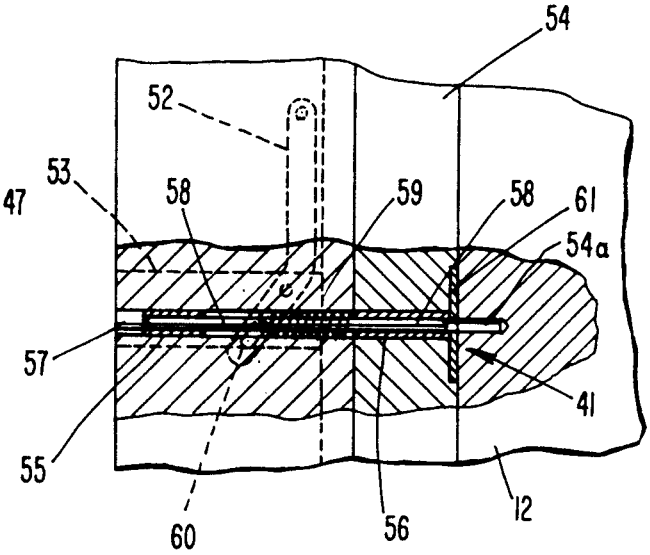
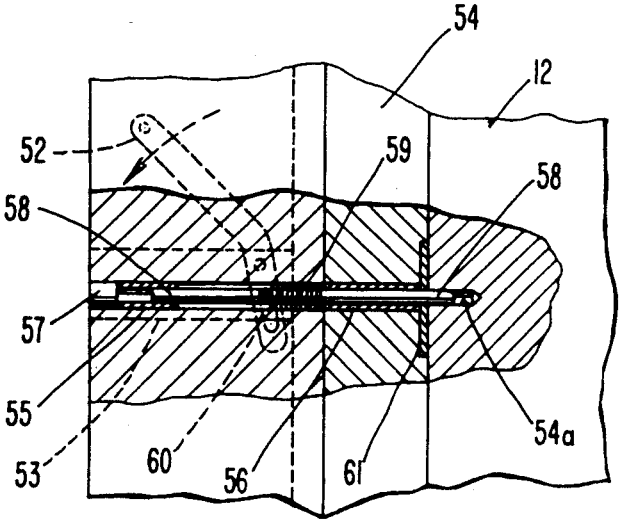
Fig. 7F
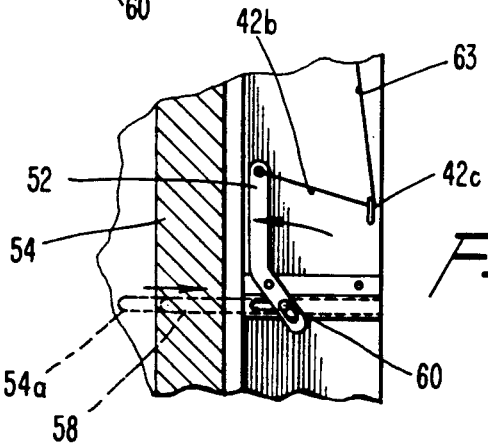
Fig. 7D

Fig. 8
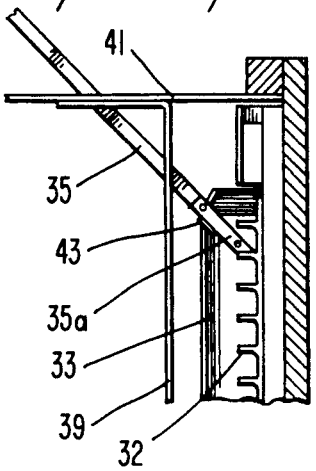
Fig. 8A
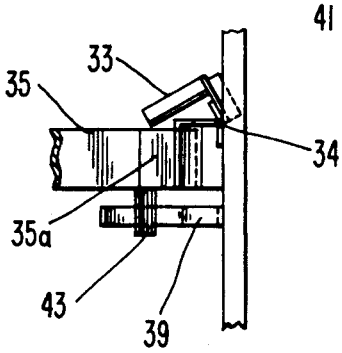
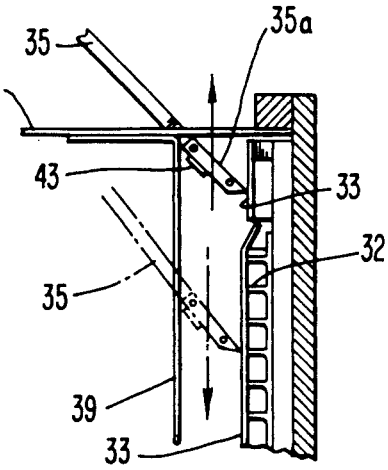
Fig. 8B
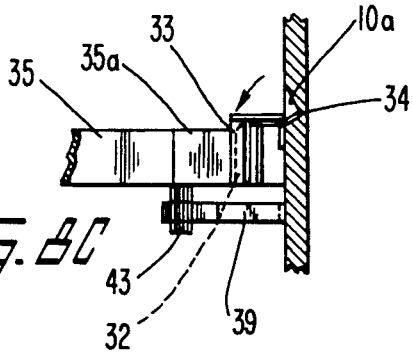
Fig. 8C
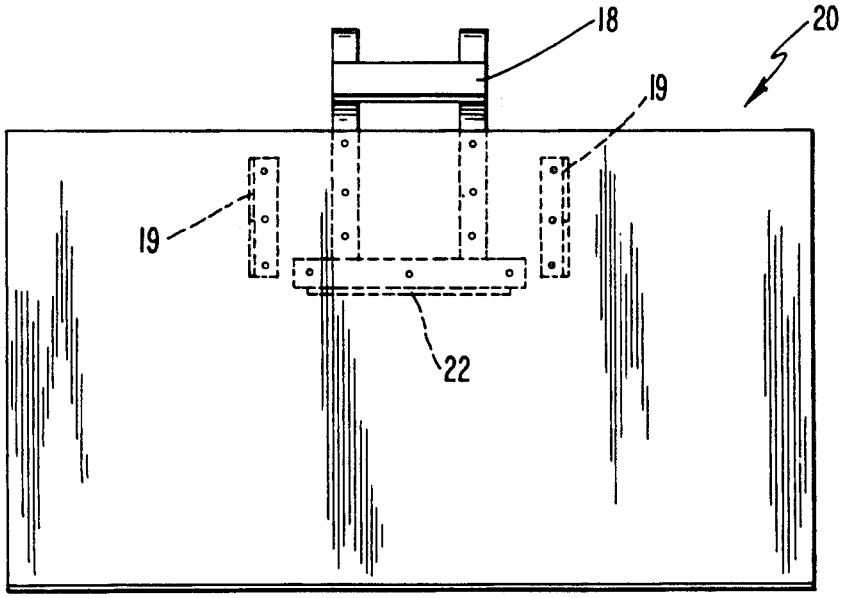
Fig. 9
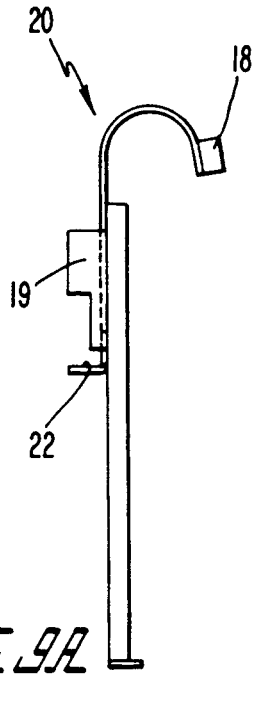
Fig. 9A

COMBINATION DRAFTING TABLE AND OFFICE DESK

BACKGROUND OF THE INVENTION

1. Field of the Invention

This invention relates, generally, to drafting tables. More particularly, it relates to a drafting table having a first pedal-operated means for slideably adjusting a drafting board relative to a platform that supports it, a second pedal-operated means for adjusting the angular orientation of the platform, and a door-locking means for locking the doors of the table when the platform is in its down position.

2. Description of the Prior Art

Drafting tables of many types have been provided by inventors.

The drafting job to be performed determines the size of the drafting board needed; as a result, facilities where draftsmen work are commonly provided with a plurality of drafting tables of differing sizes.

Moreover, one or more office desks may be needed to facilitate the performance of non-drafting work; accordingly, drafting rooms are often crowded by both drafting tables and office desks of differring sizes.

There is a need for a versatile piece of furniture that provides drafting and non-drafting office functions in the same structure.

If a combination drafting table and office desk were available, money could be saved that would otherwise be spent on space. The prior art, considered as a whole, neither teaches nor suggests how such an item of furniture could be provided.

The earlier patents of interest are U.S. Pat. No. 1,956,546 to Froelich, U.S. Pat. No. 3,364,881 to Kooi, U.S. Pat. No. 1,568,356 to Vumbaca, U.S. Pat. No. 1,615,120 to Fischer, U.S. Pat. No. 4,609,233 to Walla, U.S. Pat. No. 4,461,160 to Van Gompel, and U.S. Pat. No. 424,262 to Bogy.

SUMMARY OF THE INVENTION

The invention provides a combination drafting table and office desk in a single structure.

Drafting boards in various sizes are detachably secured to a platform that forms a part of the drafting table and are preselectable according to the size of the drawings to be prepared.

The drafting board platform is manually adjustable within limits to different angles and the drafting board supported thereby is manually adjustable to different heights. Separate operator-activated pedal means are activated to permit the manual adjustment.

The desk/table is of the two pedestal type having a knee hole between the pedestals. The pedestals are hollow and have shelving therein. Hingedly mounted door members are the closure means for the shelf area.

A locking mechanism is operative to lock the door members when the platform is in its down or horizontal position. In this manner, when the draftsman has finished a job and stored the drafting materials on the shelves, the doors are closed and the platform is lowered to automatically lock the doors in their closed position.

The structure thus provides an office desk when the platform is in its down position The platform which supports the preselected drafting board includes a metal barrier means across its lowermost edge to keep work from sliding downwardly.

Moreover, a soft wood is used in construction to enable the draftsperson to easily tack down the work with suitable pins.

The novel structure provides several significant features and advantages. By selecting a convenient size of drafting board a draftsman or secretary may do any job comfortably and easily due to the height and angular adjustability provided.

Advantageously, if the door-locking mechanism breaks for any reason, the doors automatically unlock.

It is a primary object of this invention to provide a structure capable of being used for a wide variety of drafting jobs.

Another object is to provide a drafting table that is easily convertable into an office desk.

Still another object is to provide a self-locking desk so that the draftsman need not employ keys to lock the desk after use.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which:

FIG. 4 is a rear perspective view of the drafting board platform of FIG. 2, showing a drafting board of the type shown in FIG. 3 releasably secured thereto;

FIG. 5 is a front perspective view of the height-adjusting mechanism of the novel drafting table;

FIG. 7C is a side elevational view of the door locking mechanism as a whole;

FIG. 7D is a side elevational view that substantially repeats the lower part of FIG. 7C;

FIG. 7E is a view of part of the lock assembly in its unlocked configuration;

FIG. 7F is a view of that part of the lock assembly shown in FIG. 7E in its locked configuration, FIG. 8 is a view of that part of the lock assembly shown in FIG. 7E in its adjustment of the platform, with the closure member that covers the vertically spaced teeth being shown in its open position, FIG. 8A is a top plan view thereof, FIG. 8B is a side elevational view of the parts of the two previous FIGS. but with closure member in its closed configuration, FIG. 8C is a top plan view of the FIG. 8B configuration, FIG. 9 is a front elevational view of a second embodiment of a drawing board, and FIG. 9A is a side elevational view of the board shown in FIG. 9.

Similar reference numerals refer to similar parts throughout the several views of the drawings.

DETAILED DESCRIPTION OF THE PREFERRED EMBODIMENT

Figure 1:
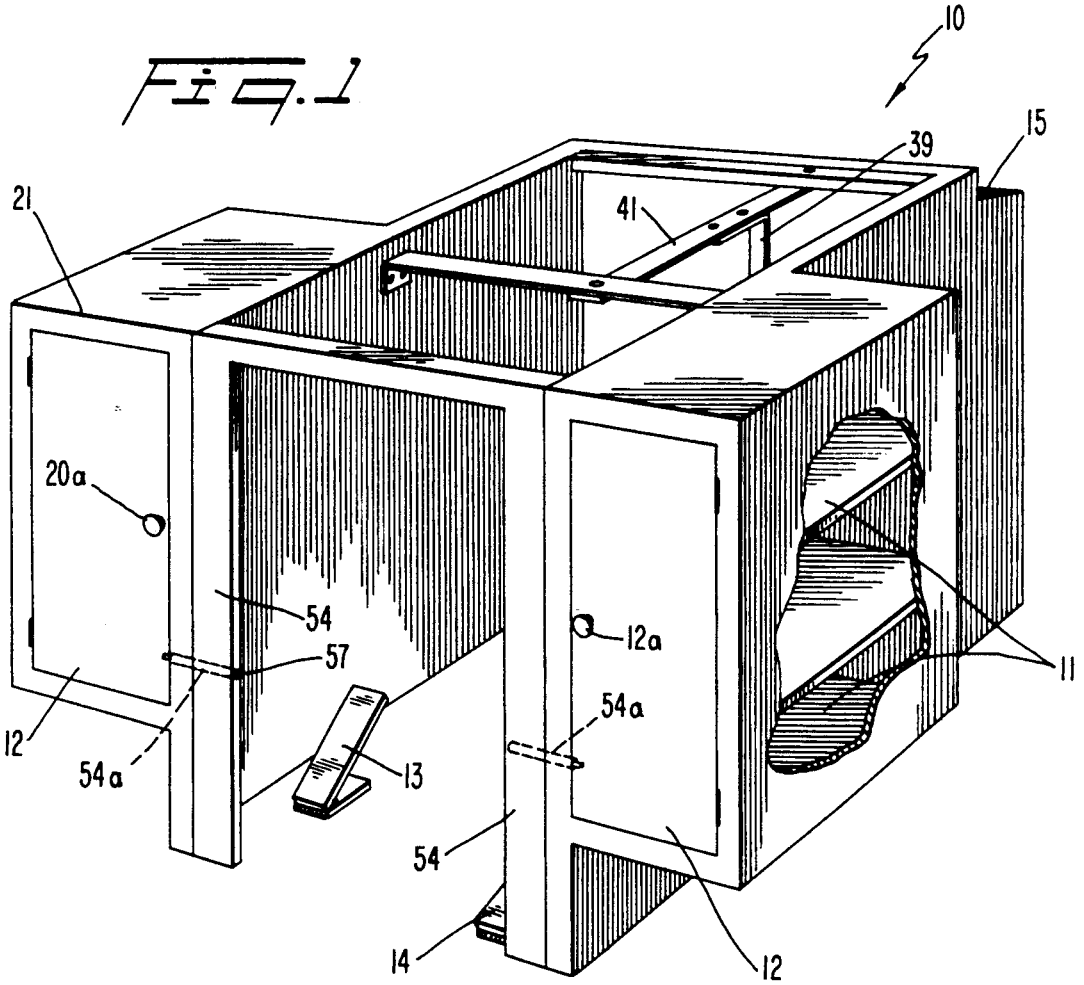
FIG. 1 is a perspective view of the basic structure of the novel drafting table. The view is from above the structure and includes a small cut-away part to show internal structure. The drafting board platform is not shown.

Referring now to FIG. 1, it will there be seen that the novel structure 10 has the general appearance of a two-pedestal desk; it has a plurality of shelves 11 provided in each pedestal as shown in the cut away part of FIG. 1 and a pair of hingedly mounted closure means or door members 12 having conventional knobs 12*a* for handles.

A paper storage compartment 15, positioned on the rearward side of the structure, provides a storage space for paper used by the draftsperson.

A pair of foot pedal members 13 and 14 are positioned in the knee hole area of the desk or table 10 adjacent the left and right pedestals, respectively; first pedal member 13 facilitates manual control of the drafting board height-adjusting function and second pedal member 14 facilitates manual control of the platform angle-adjusting function of the structure, as will be more fully set forth hereinafter.

The leading edge of the table or desk 10 is denoted 21 in FIG. 1.

Figure 2:
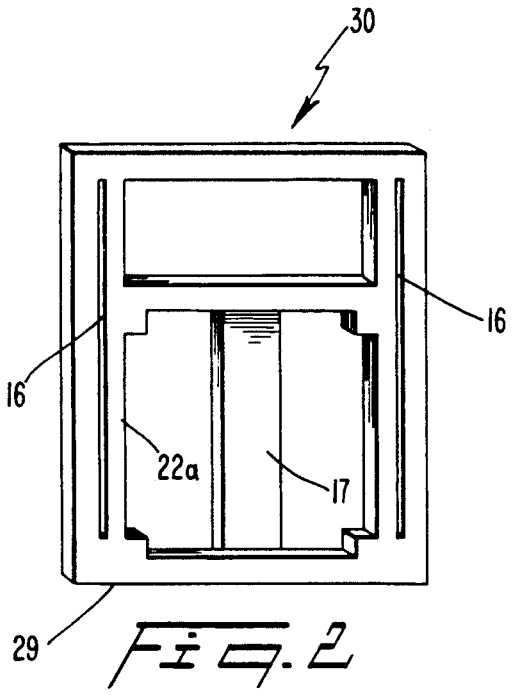
FIG. 2 is a front elevational view of the drafting board platform that forms a part of the inventive structure.

The front side of a novel platform member 30 is shown in FIG. 2. A pair of parallel, transversely spaced apart track members 16 are also shown in said FIG.

The track members 16 are grooves which slideably engage a corresponding pair of guide members, not shown in FIG. 2, that are fixedly secured to the rear side of a drafting board. Accordingly, the track members 16 releasably and slideably engage said guide members and thus allow the draftsperson to slide the board up and down relative to said track members 16 as desired. Sliding the board up relative to the platform, i.e., away from the draftsperson, does not require depression of a pedal member, but sliding the board down, i.e., towards the user, does.

The lowermost edge 29 of platform 30 hingedly engages desk 10 along leading edge 21 of said desk, as shown in FIG. 4. The hinges are marked 29*a*, collectively, in FIG. 4.

A lock swing mechanism is generally denoted 17 in FIG. 2; it forms a part of the mechanism that allows the draftsperson to slideably raise and lower the drafting board with respect to platform 30, i.e., to push the drafting board away from the user or to position it closer to the user as the job requires. Mechanism 17 spans a cut out part 22*a* formed in platform 30, rearwardly thereof.

Figure 3:
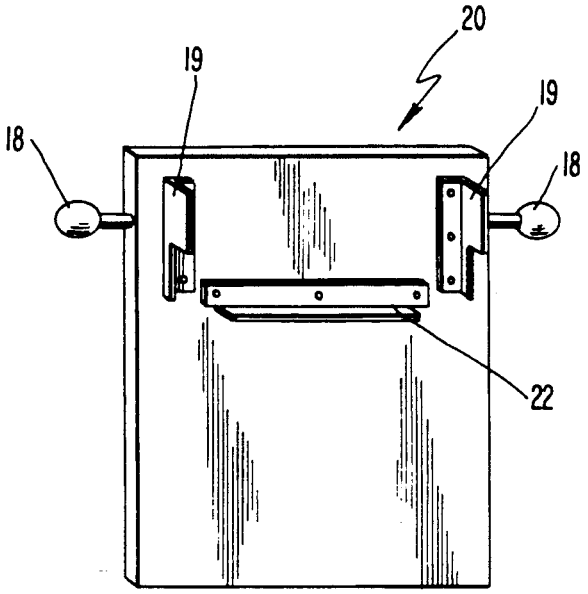
FIG. 3 is a back elevational view of a drafting board supported by the platform of FIG. 2.

The rear side of a drafting board 20 is shown in FIG. 3. A conventional board is modified to include a pair of laterally-projecting wooden handles 18 and a pair of guide members 19 which slideably engage the tracks 16 of the platform 30.

A transversely mounted elongate stop plate member 22 is positioned substantially centrally of board 20 as shown; its function is to provide a limit to the downward sliding travel of board 20 with respect to platform 30. It is received within cut out portion 22*a* of platform 30 when guide members 19, 19 are slideably received within groove members 16, 16.

A plurality of positions of height adjustment of board 20 relative to platform 30 is provided by the aforementioned lock swing mechanism 17 which is shown in greater detail in FIG. 4.

A vertically disposed lock swing plate member 50 having teeth 23 formed therein is hingedly mounted as at 24, 24 to a wooden mounting member 64 that spans the aforementioned cut out part 22*a* formed in platform 30. Hinge members 24, 24 are biased to urge the back 50*a* of plate member 50 to lie coplanar with the back 64*a* of mounting member 64.

The bias is supplied by a torque spring means 24*a* positioned internally of each of the hinge members 24.

The hinged connection between mounting member 64 and the lock swing plate 50 allows teeth 23 to swing out of the way (i.e., toward the viewer of FIG. 4) when it is desired to slide a drafting board 20 down relative to platform 30. More specifically, stop plate member 22 bears against teeth 23 as a board 20 is being slideably raised, i.e., being pushed away from the user, thereby causing lock swing plate 50 to transiently swing out of the way on hinge members 24, 24; when the board is positioned as desired, the forward bias on hinge members 24, 24, urges the teeth 23 to re-engage the stop plate member 22.

The user of the board may manually rotate the lock swing plate 50 and hence teeth 23 out of the way whenever it is desired to slideably lower the board. However, the following mechanism is preferably employed to facilitate lowering of the board.

A pulley system, generally denoted in FIG. 5 by the reference numeral 65, interconnects lock swing plate 50 and pedal member 13; depression of pedal 13 effects swinging of plate member 50 on hinges 24, 24, thereby disengaging an individual tooth 23 from its engagement with stop plate member 22. As long as pedal 13 is pressed downwardly, board 20 can be slid either up or down relative to platform 30 to whatever position is desired. Once the desired position is achieved, pedal 13 is released, and the torque-spring actuated bias on hinge members 24, 24, returns the lock swing plate 50 to its equilibrium position (depicted in FIG. 4) so that one of the teeth 23 engages and supports stop plate member 22.

Figure 5B:
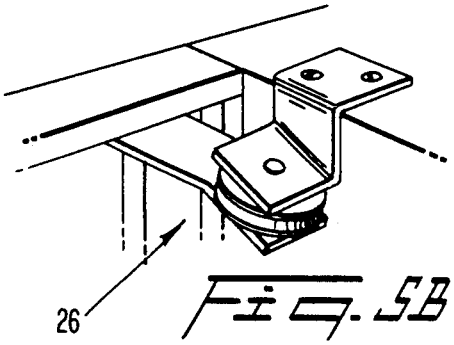
FIG. 5B is a perspective view of a second bobbin member of the height-adjusting mechanism.
Figure 5A:
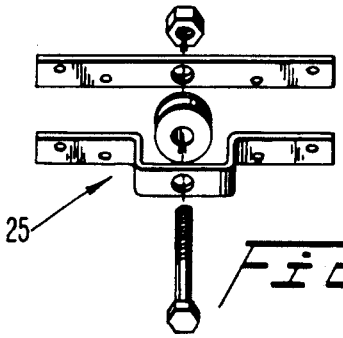
FIG. 5A is an exploded perspective view of a first bobbin member of the height-adjusting mechanism.

FIG. 5A depicts a bobbin assembly 25 and FIG. 5B shows a bobbin assembly 26 that form a part of the pulley system 65 used in the height adjusting operation. Bobbin assemblies 27 and 28 are shown in FIG. 4. A cable means denoted 29 is extended between said bobbins as shown; as shown in FIG. 4, one end of cable 29 is fixedly secured to lock swing plate 50. Its other end is fixedly secured to pedal member 13.

The mechanism employed to adjust the angular orientation of platform 30 is shown in FIGS. 4, 6, 8 and 8A–C.

FIG. 4 shows a guide arm member 35 that is hingedly connected, by hinge member 36, to the rear side of platform 30. Bias means 36*a* urges the arm 35 in the direction indicated by the directional arrow 37. Member 35 has a metal-covered distal end 35*a*.

Figure 6:
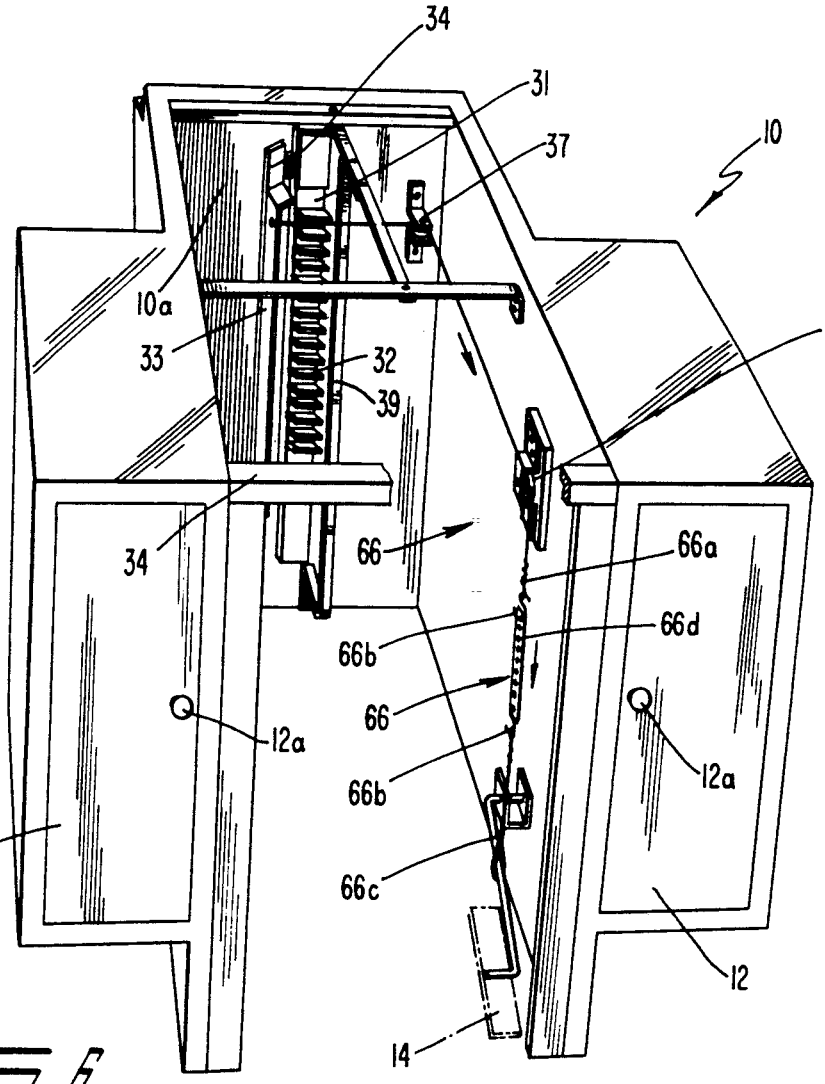
FIG. 6 is a front perspective view of the novel drafting table showing its platform angle-adjusting mechanism.

As shown in FIG. 6, vertically disposed flat base member 31 is fixedly secured to a forward surface of the back wall 10*a* of the desk or table 10, substantially centrally thereof as shown. A plurality of equidistantly spaced teeth members 32 are formed in said base member 31 and project forwardly therefrom in a horizontal plane; when the platform 30 is in a preselected angular position, metal tip 35*a* of guide arm 35 is in engagement with one of said teeth 32. Thus, the angular position of platform 30 can be manually adjusted by the user of device 10 by selectively engaging tip 35*a* and a tooth member.

A cover member 33 is hingedly mounted to base member 31 by one or more internally biased hinge members 34, 34. The visible bias means is denoted 34*a* in FIG. 6. The bias operating on hinge members 34, 34 urges cover member 33 to remain open when pedal 14 is not depressed, as depicted in FIG. 6, so that distal end 35*a* of guide arm member 35 may engage one of said teeth 32 without interference by said cover member 33.

When it is desired to lower platform 30 so that the article of furniture 10 can resume the configuration of a desk, the user manually grasps the platform and removes the weight thereof from the arm 35, i.e., the platform is tilted toward the user so that tip 35*a* disengages from its associated tooth 32. The pedal 14 is depressed to close cover member 33 and the platform is then lowered.

A cable and pulley system, generally denoted 66, interconnects cover member 33 and right foot pedal 14 so that teeth 32 may be easily covered when it is desired to lower the angular adjustment of the platform.

When pedal member 14 is depressed, cable or cord member 66*a* pulls cover member or closure means 33 into its closed position so that it overlies teeth 32. When pedal 14 is released, bias means 34*a*, 34*a* again open the cover because the teeth need not be covered when the platform is being raised into position. The teeth must be covered only when the platform is being lowered.

The operation of the closure means 33 and related parts may be more clearly depicted in FIGS. 8 and 8A–C. FIGS. 8B and 8C in particular show how the tip 35*a* of arm 35 is free to slide up or down when said closure means 33 is closed. Thus, depression of the right or second pedal enables manual readjustment of the platform angle.

Guide bar 39 is secured to center bar 41 (best shown in FIG. 1), and prevents arm 35 from moving laterally (to protect hinge 36) if an attempt is made to close closure means 33 when tip 35*a* is still in engagement with a tooth 32.

Tip 35*a* may be provided with an arcuate surface to facilitate driving of said tip out of said engagement by said closure means, but in normal operation the operator of the novel desk/table simply tilts the top of platform 30 (i, e, rotates the platform about hinges 29*a*, 29*a*) towards the front of the desk to disengage tip 35*a* from its associated tooth. The second pedal 14 is then depressed to cover the teeth so that tip 35*a* may be moved upwardly or downwardly as desired and as indicated by the double-headed directional arrow in FIG. 8B.

Laterally extending stop member 43, best shown in FIG. 8C, maintains tip 35*a* behind guide bar 39 as perhaps best understood in connection with FIG. 8B.

A much wider board 20 is shown in FIGS. 9 and 9A. It has a central handle 21 because end handles 18 (FIG. 3) would be spaced too far apart to manipulate. All other parts of wide board 20 are the same as the FIG. 3 embodiment, as indicated by the common reference numerals.

Figure 6A:
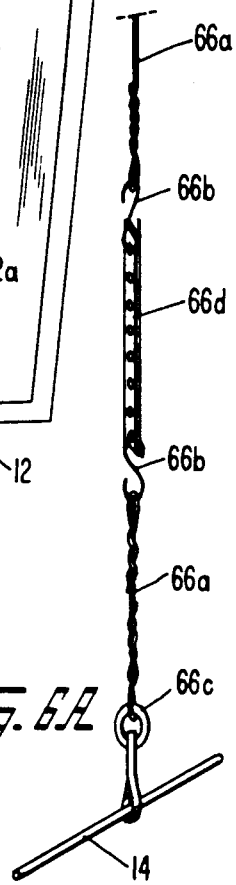
FIG. 6A is an enlargement of part of FIG. 6.

The pulley system 66 includes bobbin assemblies 37, 38, a pair of S-hooks 66*b*, an O-ring 66*c*, and an adjustment plate 66*d*, as shown in FIGS. 6 and 6A.

Platform 30 may be placed into a horizontal position when guide arm 35 is disengaged from mounting member 31. With said platform 30 in a completely horizontal position, drafting table 10 becomes a general purpose desk.

The novel locking mechanism is shown in FIGS. 7, and 7A–F, to which FIGS. attention is now directed.

The locking mechanism is denoted 40 as a whole and includes parts positioned on opposing pedestals of the desk, because opposite sides of platform 30 enter into abutting engagement with said locking mechanism.

Figure 7:
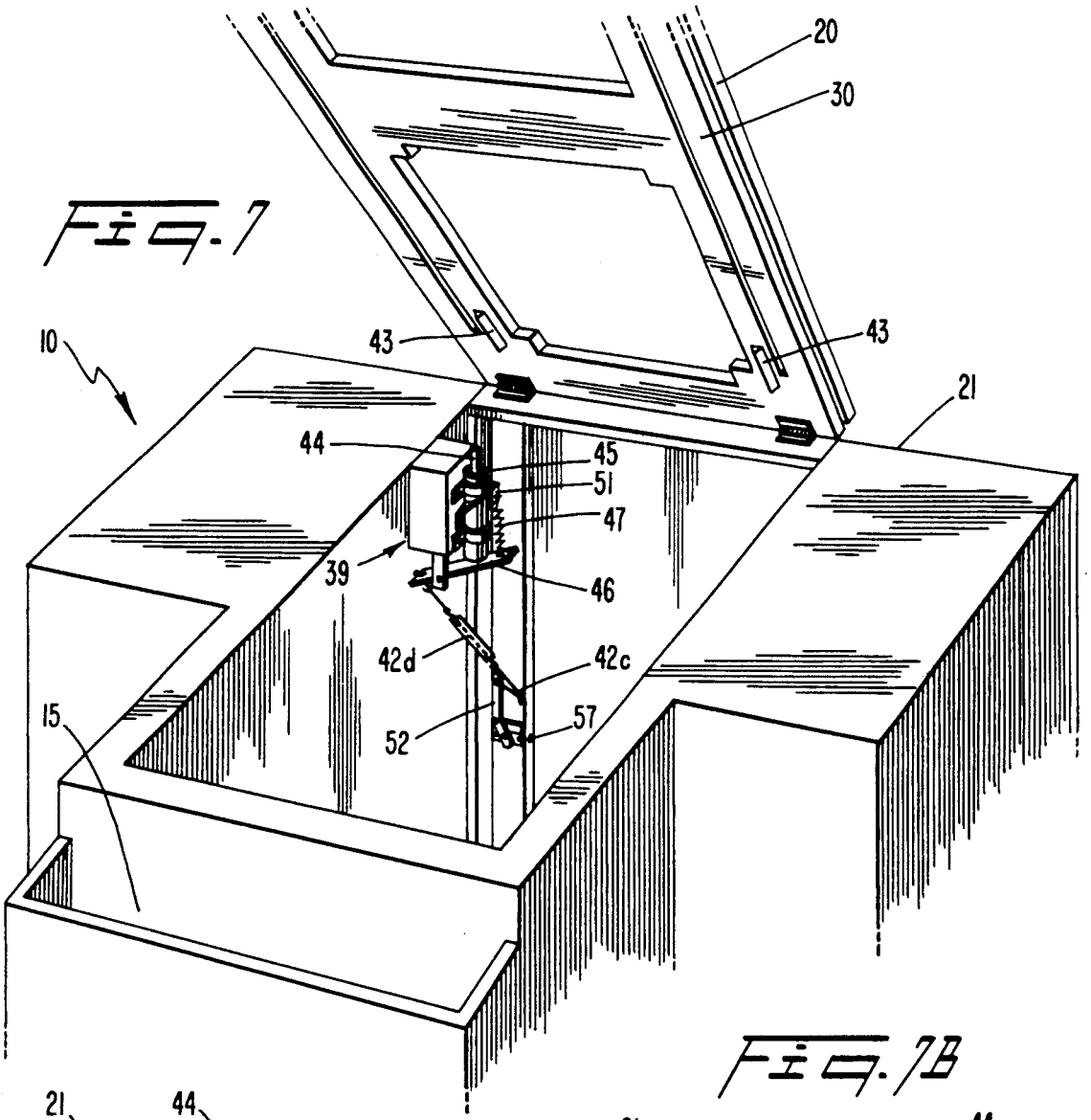
FIG. 7 is a rear perspective view of the novel drafting table showing its door locking mechanism.
Figure 7A:
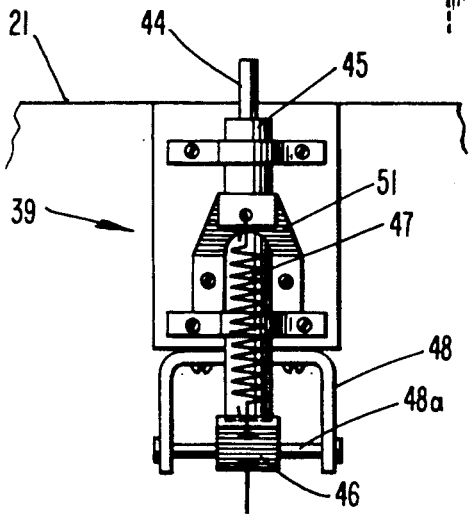
FIG. 7A is a frontal view of the pin assembly of the door locking mechanism.

Mechanism 40 consists of pin assembly 39, shown more completely in FIG. 7A, lock assembly 41, best shown in FIG. 7C and 7D, a plate assembly 43 (FIG. 7) and a pulley system 42, FIG. 7C, which system 42 includes S-hooks 42*a*, cords or cables 42*b*, a bobbin 42*c* and a perforated adjustment plate 42*d*.

Figure 7B:
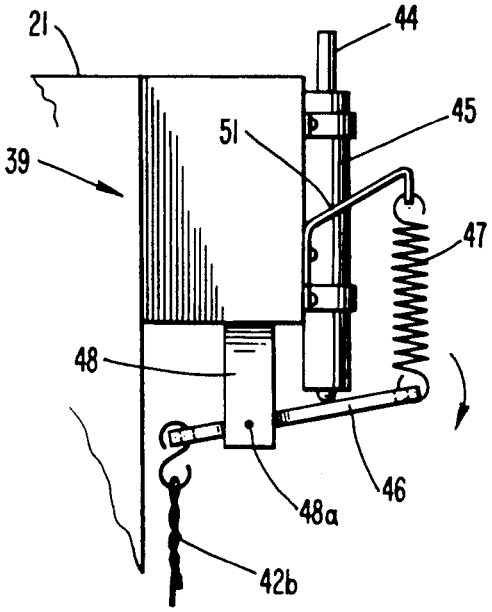
FIG. 7B is a side elevational view of the pin assembly of FIG. 7A.

As best shown in FIGS. 7A and 7B, pin assembly 39 includes a pin cylinder 45, a pin 44 being slideably received therewithin, a lock lever 46 that slideably bears against the distal free end of pin 44 as shown in FIG. 7B, said lever 46 being pivotally secured as at 48*a* to a lock lever holder 48. Pin 44 is driven downwardly when plate 43 bears against it; since plate 43 is fixedly secured to the underside of platform 30, pin 44 is driven downwardly when platform 30 is lowered into its horizontal position.

As depicted in FIG. 7B, lever 46 pivots in a counterclockwise direction when pin 44 is driven downwardly by said plate 43.

Pin assembly 39 further includes spring 47 which extends between lock lever 46 and spring mounting plate 51, as shown in FIGS. 7A and 7B, which plate 51 in turn is fixedly secured to pin cylinder 45.

Accordingly, raising platform 30 from its horizontal position disengages plate 43 from the uppermost end of pin 44; the bias supplied by spring 47 thus urges pin 44 to withdraw into its cylinder 45 as is perhaps best understood in connection with FIG. 7C.

Referring now to FIGS. 7D, 7E and 7F, there it will be seen that lock assembly 41 further includes a pivot lever 52 pivotally secured to a lever clamp 53 which is fixedly secured to frame 54 (see FIG. 7).

It also includes cylinders 55 and 56 (FIGS. 7E and 7F) which are press-fit into a bore means formed in frame 54.

Wooden plug member 57 closes the bore means as shown in FIG. 7E. Moreover, rod member 58 interconnects cylinder members 55 and 56. Spring member 59 surrounds rod 58 as shown. An elongate bolt member 60 extends normal to rod member 58 and abuts spring 59 when spring 59 is at rest. A centrally apertured plate member 61 guides rod member 58 into a rod-receiving bore formed in each door 12.

As shown in FIG. 7D, guide bar member 62 is provided with an elongate slot means that slideably receives bolt member 60. Pivotal movement of lever 52 effects sliding of bolt member 60 within said slot and said sliding of said bolt member effects extension and retraction of pin 58 as aforesaid.

Pivotal movement of lever 52 is effected by pulley system 42 which includes cable member 63 attached to lock lever 46 through an S hook as shown.

Those skilled in the mechanical arts will note that an involuntary unlocking of a door 12 may occur if a cable or cord 63 breaks, but that an involuntary locking is impossible.

The specific paths of travel of the cord or cable system shown herein are not the only paths of travel that could be employed; moreover, those skilled in the mechanical arts could use a different number of pulley members or bobbins, and could eliminate entirely the S hooks and other convenient but not indispensable parts of the preferred construction.

It will thus be seen that the objects set forth above, and those made apparent by the preceding description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An article of furniture, comprising:

a two pedestal desk;

a platform member hingedly mounted at its bottom to a leading edge of said desk;

a platform tilting means;

said platform tilting means including an elongate, rigid platform support member hingedly mounted to a rear side of said platform member, at the top thereof;

said platform support member having a distal free end;

a vertically disposed base member fixedly secured to a back wall of a kneehole area of said desk;

a plurality of vertically spaced teeth members formed in said base member;

a cover member hingedly secured to said base member;

said cover member having an open position and a closed position, said teeth members being releasably engageable by said distal free end of said platform support member only when said cover member is open, said cover member barring engagement between said teeth members and said distal free end of said platform support member when said cover member is closed;

said cover member being biased into said open position;

a first pedal means;

a first cable means disposed in interconnecting relation between said cover member and said first pedal means, said first cable means operative to swing said cover member about its hinges into said closed position, thereby covering said teeth members, when said first pedal means is activated;

said platform member being manually tiltable when said teeth members are covered by said cover member; and said platform member having a closed position where it is coplanar with a top surface of said desk.

2. The article of furniture of claim 1, further comprising:

a drafting board member that overlies and is supported by said platform member;

a pair of vertically aligned, transversely spaced groove members formed in a top surface of said platform member;

and a cooperatively positioned pair of guide members projecting from a back surface of said drafting board member;

whereby said drafting board member is supported by said platform member and whereby the position of said drafting board member relative to said platform member is adjusted by sliding said guide members within said groove members.

3. The article of furniture of claim 2, further comprising:

a cut away part formed in said platform member, substantially centrally thereof;

a transversely mounted stop plate member fixedly secured to a back surface of said drafting board member and projecting rearwardly therefrom through said cut away part;

a vertically disposed mounting member disposed in spanning relation to said cut away part of said platform member;

a vertically disposed lock swing plate member hingedly secured to said mounting member;

bias means for urging said lock swing plate member to lie coplanar with said mounting member;

a plurality of vertically spaced, forwardly projecting teeth members integrally formed on a forward surface of said lock swing plate member;

said stop plate member configured to engage a preselected lock swing plate tooth member when said lock swing plate member is coplanar with said mounting member to thereby maintain said drafting board member in a preselected position relative to said platform member;

a second pedal means; and a second cable means extending in interconnecting relation between said second pedal means and said lock swing plate member, said second cable means operative to swing said lock swing plate member and its integral teeth members away from said stop plate member to facilitate manual repositioning of said drafting board member relative to said platform member when said second pedal means is activated.

4. The article of furniture of claim 3, further comprising:

a first hollow pedestal having first shelving means disposed therein;

a second hollow pedestal having second shelving means disposed therein;

a kneehole means separating said first and second pedestals;

first and second vertically disposed frame members secured to said first and second pedestals, respectively, at a forward edge of said kneehole means;

a first hingedly mounted door member for closing said first pedestal to secure items stored on said first shelving means;

a second hingedly mounted door member for closing said first pedestal to secure items stored on said second shelving means;

said first and second door members having first and second bore means formed therein, respectively, on facing edges thereof;

said first and second frame members having bore means formed therein in axial alignment with the first and second bore means formed in said door members, respectively;

a slideable rod member positioned in each of said frame member bore means;

and door-locking means associated with said platform member to effect extension of said rod members into said first and second bore means when said platform member is horizontally disposed in coplanar relation to a top surface of said desk.

5. An article of furniture in the form of a combination drafting table and office desk, comprising;

a pair of laterally spaced pedestal members;

a drafting board-supporting platform member hingedly mounted to a leading edge of said article of furniture;

a platform support member being hingedly mounted to a rear side of said platform member;

a first pedal member positioned in a kneehole area of said article of furniture;

a vertically disposed base member being mounted to a back wall of said kneehole area of said article of furniture;

a plurality of vertically spaced teeth members being formed on said base member;

a cover member being hingedly mounted on said base member and being operative to cover said teeth members when said cover member is in a closed position;

said cover member being biased into an open position where said teeth members are not covered by said cover member;

a distal end of said platform support member being releasably engageable between any preselected contiguous pair of tooth members of said plurality of tooth members when said cover member is open;

said distal end of said platform support member being barred from engagement with any of said pair of tooth members by said cover member when said cover member is in said closed position so that manual pivoting of said platform member about its hinge may take place without interference caused by engagement between the teeth members and the distal end of the platform support member;

first cable means connected between said first pedal member and said cover member so that activation of said first pedal member causes said cover member to swing about its hinges into said closed position and hence into covering relation to said teeth members;

a drafting board member adapted to be placed atop said platform member;

a second pedal member;

said platform member having a pair of laterally spaced groove members formed in its front side;

said drafting board member having a pair of laterally spaced, rearwardly projecting guide members formed in its rear side;

said guide members being positioned in sliding registration with said groove members so that the position of said drafting board member relative to said platform member is manually adjustable;

a stop plate member being fixedly secured to a rear side of said drafting board member;

a cut away part formed in said platform member;

said stop plate member being specifically configured to be received within said cut away part;

an elongate mounting member fixedly secured to a rear side of said platform member, said mounting member being vertically disposed in spanning relation to said cut away part;

a lock swing plate member being hingedly secured to said mounting member;

a plurality of vertically spaced tooth members formed in a front surface of said lock swing plate member;

said tooth members operative to selectively engage said stop plate member when said lock swing plate member is coplanar with said mounting member so that the position of the drafting board member with respect to said platform member is determined by selective engagement of said stop plate member and a tooth member of said lock swing plate member;

said lock swing plate member being biased to urge said lock swing plate member to lie coplanar with said mounting member;

second cable means connected between said second pedal member and said lock swing plate member;

activation of said second pedal member causing said lock swing plate member to swing away from its coplanar alignment with said mounting member to thereby facilitate manual adjustment of the position of said drafting board member with respect to said platform member.

6. The article of claim 5, further comprising:

each of said pedestal members being hollow and having shelf members positioned therewithin; and a hingedly mounted door member closing a front side of each of said pedestal members so that access to preselected shelf members may be had when a door member is open.

7. The article of claim 6, further comprising a door locking means for locking said door members when said platform member is in a horizontal plane coincident with the plane of said desk top surface.

8. In an article of furniture in the form of a combination drafting table and office desk of the type having a kneehole area flanked by two laterally spaced pedestal members, comprising:

a hingedly mounted platform member;

a pair of vertically aligned, transversely spaced groove members formed in a top surface of said platform member;

a hingedly mounted door member closing a front side of each of said pedestal members;

a drafting board member that slideably engages and overlies said platform member;

a pair of vertically aligned, transversely spaced guide members projecting from a back surface of said drafting board member;

each of said guide members being slideably engageable in an associated groove member to that said drafting board member is supported by and slideably engages said platform member;

a pulley and cable means for locking said door members when said platform member is in a closed, horizontal position;

a pair of vertically disposed frame members fixedly secured to opposite pedestal members at the respective forwardmost edges thereof, each of said frame members having a horizontally disposed bore means formed therein;

a horizontally disposed bore means formed in each of said door members, said door member bore means being in axial alignment with said frame member bore means when said door members are closed a pair of biased lever members, each lever member of said pair of lever members being pivotally secured to an associated dead bolt member;

each of said lever members being biased such that their associated dead bolt members are retracted into their respective frame member bore means when said lever members are in an equilibrium condition so that non-functioning of the lever members results in non-extension of the dead bolt members and hence unlocking of the door members;

a pair of cylinder members, each of which has an upwardly biased plunger member projecting upwardly therefrom, said cylinder members being mounted on opposite sides of said kneehole area of said article of furniture such that only the plunger members are positioned above a horizontal plane defined by the desk top surface of said article of furniture;

a pair of downwardly projecting protuberances being secured to a bottom side of said platform member on opposite laterally spaced sides thereof, said protuberances abuttingly engaged and driving down said plunger members when said platform member is in its closed position;

a pair of lock lever members, each lock lever member of said pair of lock lever members being positioned below an associated plunger member in closely spaced relation thereto and being pivoted when abuttingly engaged by its associated plunger member; and a pair of cables, each cable of said pair of cables extending in interconnecting relation between a first end of an associated lock lever and an associated dead bolt lever so that each said dead bolt lever is pivoted and its associated dead bolt is extended into said door member bore means, thereby locking said door member, when each said lock lever is pivoted by its associated protuberance.

* * * * *